US005470509A

United States Patent [19]

Pancheri

[11] Patent Number: 5,470,509

[45] Date of Patent: Nov. 28, 1995

[54] LOW PH GRANULAR DETERGENT COMPOSITION HAVING IMPROVED BIODEGRADABILITY AND CLEANING PERFORMANCE

[75] Inventor: Eugene J. Pancheri, Montgomery, Ohio

[73] Assignee: The Procter & Gamble Company, Cincinnati, Ohio

[21] Appl. No.: 313,654

[22] Filed: Sep. 26, 1994

Related U.S. Application Data

[63] Continuation of Ser. No. 92,048, Jul. 15, 1993, abandoned.

[51] Int. Cl.[6] ..... C11D 3/386

[52] U.S. Cl. ..... 252/544; 252/548; 252/174.25; 252/174.12; 252/DIG. 12; 252/89.1; 252/529; 134/42

[58] Field of Search ..... 252/174.12, DIG. 12, 252/529, 544, 548, 89.1; 134/42; 435/188

[56] References Cited

U.S. PATENT DOCUMENTS

| | | | |
|---|---|---|---|
| 2,220,099 | 11/1940 | Guenther et al. | 260/505 |
| 2,703,798 | 3/1955 | Schwartz | 260/211 |
| 3,664,961 | 5/1972 | Norris | 252/99 |
| 3,755,085 | 8/1973 | Tivin et al. | 195/68 |
| 3,852,211 | 12/1974 | Ohren et al. | 252/110 |
| 3,860,536 | 1/1975 | Landwerlen et al. | 252/551 |
| 3,893,954 | 7/1975 | Tivin | 252/548 |
| 3,915,882 | 10/1975 | Nirschl et al. | 252/131 |
| 3,936,537 | 2/1976 | Baskerville, Jr. et al. | 427/242 |
| 4,136,045 | 1/1979 | Gault et al. | 252/135 |
| 4,144,226 | 3/1979 | Crutchfield et al. | 528/231 |
| 4,222,905 | 9/1980 | Corkrell, Jr. | 252/547 |
| 4,228,044 | 10/1980 | Cambre | 252/547 |
| 4,239,659 | 12/1980 | Murphy | 252/524 |
| 4,261,868 | 4/1981 | Hora et al. | 252/529 |
| 4,379,080 | 4/1983 | Murphy | 252/526 |
| 4,462,922 | 7/1984 | Boskamp | 252/174.12 |
| 4,486,327 | 12/1984 | Murphy et al. | 252/94 |
| 4,490,271 | 12/1984 | Spadini et al. | 252/174 |
| 4,605,509 | 8/1986 | Corkill et al. | 252/131 |
| 4,663,071 | 5/1987 | Bush et al. | 252/174.19 |
| 4,762,645 | 8/1988 | Tucker et al. | 252/544 |
| 4,810,413 | 7/1989 | Pancheri et al. | 252/174.12 |
| 4,857,114 | 8/1989 | Brumbaugh et al. | 134/42 |
| 4,906,395 | 3/1990 | Stoesser et al. | 252/90 |
| 4,933,287 | 6/1990 | Farin et al. | 435/198 |
| 5,030,378 | 7/1991 | Venegas | 252/174.12 |
| 5,039,446 | 8/1991 | Estell | 252/174.12 |
| 5,051,212 | 9/1991 | Culshaw et al. | 252/546 |
| 5,059,341 | 10/1991 | Holmes | 252/174.12 |
| 5,069,810 | 12/1991 | Holmes et al. | 252/174.12 |
| 5,153,135 | 10/1992 | Farin et al. | 435/253.3 |
| 5,178,789 | 1/1993 | Estell | 252/174.12 |

FOREIGN PATENT DOCUMENTS

| | | | |
|---|---|---|---|
| 0503219A1 | 9/1992 | European Pat. Off. | C11D 3/30 |
| 1335113 | 10/1973 | United Kingdom | C11D 7/42 |
| 9117232 | 11/1991 | WIPO . | |
| WO91/17234 | 11/1991 | WIPO | C11D 3/02 |

*Primary Examiner*—Paul Lieberman
*Assistant Examiner*—Kery A. Fries
*Attorney, Agent, or Firm*—Ken K. Patel; J. C. Rasser; J. J. Yetter

[57] ABSTRACT

The invention provides a low pH granular detergent composition comprised of biodegradable components, together which provide a detergent with improved cleaning performance. The granular detergent composition comprises: (a) from about 5% to about 50% by weight of a detergent surfactant selected from the group consisting of anionic, nonionic, zwitterionic, ampholytic, cationic and mixtures thereof; (b) from about 5% to about 50% by weight of a non-phosphorous detergent builder; (c) from about 0% to about 5% of an enzyme component; and (d) from about 0.25% to about 5% of a compound selected from the group consisting of tris(hydroxymethyl)amino-methane aminomethyl propanediol, aminoethyl propanediol and mixtures thereof. The detergent composition has a pH of from about 8.0 to about 9.0 and is substantially free of phosphates and polyacrylates.

6 Claims, No Drawings

LOW PH GRANULAR DETERGENT COMPOSITION HAVING IMPROVED BIODEGRADABILITY AND CLEANING PERFORMANCE

CROSS REFERENCE TO RELATED APPLICATION

This is a continuation of application Ser. No. 08/092,048, filed on Jul. 15, 1993, now abandoned.

FIELD OF THE INVENTION

The present invention generally relates to a detergent composition exhibiting superior cleaning performance. More particularly, the invention is directed to a low pH granular detergent composition containing a compound selected from the group consisting of tris(hydroxymethyl)aminomethane, aminomethyl propanediol, aminoethyl propanediol and mixtures thereof. The granular detergent composition of the invention surprisingly has improved biodegradability combined with improved cleaning performance.

BACKGROUND OF THE INVENTION

It is commonly known that chlorine is used in many parts of the world to purify water. For purposes of insuring that the water is safe for use and consumption, a small residual amount of chlorine is left in the water. It has been found that even a small amount of chlorine significantly harms or hinders the beneficial effect of the components in detergent compositions, especially the enzyme components. For example, Tivin et al, U.S. Pat. No. 3,755,085, describes such a finding in detail. Typically, the residual amount of free chlorine found in most water will attack and inactivate the enzymes contained in detergent compositions. This, obviously, eliminates or reduces the effectiveness of enzymes, thereby reducing the overall performance of typical detergent compositions.

To alleviate such problems, it has been well known to include "chlorine scavengers" or components which inactivate the free chlorine oftentimes found in washing water. Representative of the art is Pancheri et al, U.S. Pat. No. 4,810,413 and Spadini et al, U.S. Pat. No. 4,490,271, both of which are commonly assigned. Pancheri et al disclose a granular detergent composition containing a low level of ammonium salt which is protected in a particle. The particles use a polyethylene glycol carrier with a small amount of fatty acid in an irregular shaped particle having a minimum dimension of about 0.05 cm. The Spadini et al patent is directed to a detergent composition containing a surfactant, builder, and a mixture of polyethylene glycol and polyacrylate. The polyethylene glycol and polyacrylate are in a weight ratio of 1:10 to 10:1 wherein the polyethylene glycol has an average molecular weight from 1000 to 50,000 and the polyacrylate has a weight ratio from 1000 to 2000.

Both Pancheri et al and Spadini et al disclose the use of ammonium salts of polyacrylate to serve as chlorine scavengers for purposes of achieving improved cleaning performance by virtue of their inactivation of the residual chlorine present in the wash water. While such chlorine scavengers perform satisfactorily, they are not considered biodegradable to the extent desired by skilled artisans especially interested in biodegradability. The non-biodegradability characteristic of polyacrylates is especially prevalent in most detergent compositions.

There also have been a wide variety of builders used in detergent compositions for purposes of increasing the effectiveness of surfactants in detergents by softening, i.e. removing the hardness from washing solutions. For example, phosphate-based builders such as pentasodium triphosphate have been found to be effective in detergent formulations. The phosphate-based builders, however, have been held responsible for eutrophication of rivers and lakes, i.e. increasing the algae growth and oxygen consumption. Accordingly, measures have been taken to limit the content of phosphates in detergents.

Accordingly, there is a need in the art for a detergent composition which is more biodegradable as a result of incorporating more biodegradable components. Also, there is a need for such a detergent composition which exhibits improved cleaning performance.

SUMMARY OF THE INVENTION

The needs identified above are met by the present invention which provides a low pH granular detergent composition comprised of substantially biodegradable components. Additionally, the granular detergent composition of the present invention surprisingly exhibits superior cleaning performance. All proportions used herein are expressed in "percent by weight" unless otherwise indicated.

In accordance with one aspect of the invention, the granular detergent composition comprises: (a) from about 5% to about 50% by weight of a detergent surfactant selected from the group consisting of anionic, nonionic, zwitterionic, ampholytic, cationic and mixtures thereof; (b) from about 5% to about 50% by weight of a non-phosphorous detergent builder; (c) from about 0% to about 5% of an enzyme component; and (d) from about 0.25% to about 5% of a compound selected from the group consisting of tris(hydroxymethyl)aminomethane, aminomethyl propanediol, aminoethyl propanediol and mixtures thereof. The detergent composition has a pH of from about 8.0 to about 9.0 and is substantially free of phosphates and polyacrylates. The detergent composition includes an amino compound such as tris(hydroxymethyl)aminomethane which serves, in part, as a chlorine scavenger. Thus, it is preferable for the present detergent composition to be substantially free of bleaching agents which eliminate the need for chlorine scavengers in the detergent composition. The invention also provides a method of laundering soiled clothes by contacting the clothes with an effective amount of a detergent composition in accordance with the invention.

Accordingly, it is an object of the present invention to provide a low pH detergent composition which is more biodegradable as a result of incorporating a biodegradable chlorine scavenger and non-phosphated builders. It is also an object of the invention to provide such a detergent composition which exhibits improved cleaning performance. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The granular detergent composition of the invention comprises at least a detergent surfactant, a non-phosphorous builder and an amino compound selected from the group consisting of tris(hydroxymethyl)aminomethane, aminomethyl propanediol, aminoethyl propanediol and mixtures thereof. Specifically, the detergent composition preferably contains from about 0.25% to about 5%, more preferably from about 0.5% to about 4%, most preferably from about 0.75% to about 2%, of the compound. In addition to those amino compounds described herein, other compounds which have a molecular weight from about 100 to about 200, include at least one primary amine group, at least two alcohol groups, a $pK_a$ between about 7.5 and 9.0, and a vapor pressure of less than about 0.01 mm Hg can, be used in the present detergent composition.

The preferred compound is tris(hydroxymethyl)aminomethane which is also referenced as 2-amino-2-hydroxymethyl-1,3-propanediol (hereinafter referred to as "TRIS"). The granular detergent composition of the invention preferably includes a level of TRIS which is lower than those levels used when TRIS serves as a buffering agent. It has been found that TRIS is an extremely suitable biodegradable substitute for polyacrylates and other non-biodegradable chlorine scavengers, especially when incorporated into low pH granular detergent compositions. Moreover, the use of TRIS in such detergent composition provides unexpected and superior cleaning performance, as well.

Preferably, the TRIS used in the granular detergent composition has the formula

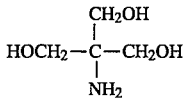

While TRIS may be readily synthesized by well known reaction schemes, it can be conveniently purchased from a wide variety of commercial sources. For example, a TRIS compound suitable for use herein can be purchased from Angus Chemical Company under the product name TRIS AMINO®.

In addition, the detergent composition preferably has a relatively low pH, preferably from about 8.0 to about 9.0, more preferably from about 8.2 to about 8.8. With the essential components and parameters described herein, the granular detergent of the present invention exhibits unexpectedly superior cleaning performance without the use of phosphate-based builders, polyacrylates and/or other similar non-biodegradable compounds. Also, as mentioned previously, the present detergent composition is substantially free of bleaching agents and activators, the presence of which would generally eliminate the need for chlorine scavenging compounds, such as TRIS.

Detergent Surfactant

The low pH granular detergent composition preferably contains from about 5% to about 50%, more preferably from about 10% to about 45%, most preferably from about 15% to about 40%, of a surfactant. The detergent surfactants are selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,919,678, Laughlin et al., issued Dec. 30, 1975, both of which are incorporated herein by reference.

Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference. Of the surfactants, anionics and nonionics are preferred and anionics are most preferred. The following are representative examples of detergent surfactants useful in the present granules. Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional anionic surfactants which suitable for use herein include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

In addition, suitable anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Preferred anionic surfactants are $C_{10-18}$ linear alkylbenzene sulfonate and $C_{10-18}$ alkyl sulfate. If desired, low moisture (less than about 25% water) alkyl sulfate paste can be the sole ingredient in the doughy mass. Most preferred is a combination of the two. A preferred embodiment of the present invention is wherein the doughy mass comprises from about 20% to about 40% of a mixture of sodium $C_{10-13}$ linear alkylbenzene sulfonate and sodium $C_{12-16}$ alkyl sulfate in a ratio of about 2:1 to 1:2.

Water-soluble nonionic surfactants are also useful in the instant invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol. Included are the water-soluble and water-dispersible condensation products of aliphatic alcohols containing from 8 to 22 carbon atoms, in either straight chain or branched configuration, with from 3 to 12 moles of ethylene oxide per mole of alcohol.

An additional group of nonionics suitable for use herein are semi-polar nonionic surfactants which include water-soluble amine oxides containing one alkyl moiety of from abut 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80. Particularly preferred are condensation products of $C_{12}$–$C_{15}$ alcohols with from about 5 to about 20 moles of ethylene oxide per mole of alcohol, e.g., $C_{12}$–$C_{13}$ alcohol condensed with about 6.5 moles of ethylene oxide per mole of alcohol.

Additional suitable nonionic surfactants include polyhydroxy fatty acid amides of the formula

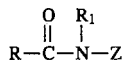

wherein R is a $C_{9-17}$ alkyl or alkenyl, $R_1$ is a methyl group and Z is glycityl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, the disclosure of which is incorporated herein by reference.

Detergent Builder

The detergent composition preferably contains from about 5% to about 50%, more preferably from about 10% to about 45%, and most preferably from about 15% to about 40%, of a detergent builder. Builders suitable for use herein include silicates, borates, polyhydroxy sulfonates, polyacetates, and nonphosphorous, inorganic builders.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, M being an alkali metal, and having a $SiO_2$:$M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized herein, as well. Aluminosilicates including zeolites are suitable for use herein and are more fully discussed in Corkill et al, U.S. Pat. No. 4,605,509, the disclosure of which is incorporated herein by reference. Also, crystalline layered silicates such as those discussed in Corkill et al, U.S. Pat. No. 4,605,509, incorporated herein by reference, are suitable for use in the detergent composition of the invention.

Enzyme

While not essential to the detergent composition of the invention, it is preferable to include an enzyme, especially since one of the functions of compounds such as TRIS is to serve as a chlorine scavenger so as to preserve the activity of the enzymes during typical washing conditions. Suitable enzyme components are available from a wide variety of commercial sources. For example, suitable enzymes are available from NOVO Industries under product names T-Granulate™ and Savinase™, and Gist-Brocades under product names Maxacal™ and Maxatase™. Included within the group of enzymes are proteases, amylases, lipases, cellulases and mixtures thereof.

The enzyme level preferably should be from about 0% to about 5%, more preferably from about 0.1% to about 2.5%, and most preferably from about 0.2% to about 1%. Typically, proteases are used at an Activity Unit (Anson Unit) level of from about 0.001 to about 0.05, most preferably from about 0.002 to about 0.02, while amylases are used at an amylase unit level of from about 5 to about 5000, most preferably from about 50 to about 500 per gram of detergent composition.

Optional Detergent Ingredients

The detergent composition of the present invention can also include any number of additional ingredients. These include other detergency builders, suds boosters or suds suppressers, anti-tarnish and anticorrosion agents, soil suspending agents, soil release agents, germicides, pH adjusting agents, non-builder alkalinity sources, chelating agents, smectite clays, additional enzymes, enzyme-stabilizing agents and perfumes. See U.S. Pat. No. 3,936,537, issued Feb. 3, 1976 to Baskerville, Jr. et at., the disclosure of which is incorporated herein by reference.

Chelating agents are also described in U.S. Pat. No. 4,663,071, Bush et at., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference. Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLE I

The following Example presents granular detergent compositions A–C, of which composition B and C are made within the scope of the invention while composition A is outside the present invention. More specifically, compositions B and C include various levels of TRIS and are completely devoid of polyacrylate and a bleaching agent, while composition A is substantially free of TRIS and includes polyacrylate and a bleaching agent (perborate).

TABLE I

| | Compositions (% weight) | | |
|---|---|---|---|
| | A | B | C |
| Base Granule | | | |
| $C_{11-14}$ linear alkylbenzene sulfonate | 13.5 | 13.5 | 13.5 |
| $C_{14-15}$ alkyl sulfate | 4.3 | 4.3 | 4.3 |
| $C_{14-15}$ alkyl ethoxy sulfate (EO3) | 1.3 | 1.3 | 1.3 |
| Sodium sulfate | 5.4 | 5.4 | 5.4 |
| Brightener | 0.2 | 0.2 | 0.2 |
| Sodium citrate | 12.4 | 12.4 | 12.4 |
| Sodium carbonate | 11.1 | 11.1 | 11.1 |
| Aluminosilicate | 29.2 | 29.2 | 29.2 |
| Sodium polyacrylate (MW4500) | 3.6 | — | — |
| Perborate | 1.0 | — | — |
| Admix and Spray-on | | | |
| Lipolase | 0.2 | 0.2 | 0.2 |
| Cellulase | 0.6 | 0.6 | 0.6 |
| $C_{12-13}$ alkyl ethoxylate (6.5 mole) | 0.3 | 0.3 | 0.3 |
| Amylase | 0.9 | 0.9 | 0.9 |
| TRIS | — | 1.0 | 2.0 |
| Misc. (water, perfume, etc.) | 16.0 | 19.6 | 18.6 |
| | 100.0 | 100.0 | 100.0 |
| pH | 8.3 | 8.4 | 8.5 |

Compositions A–C are formulated for use at a level of about 1400 ppm; wash water weight basis, and at temperatures below about 50° C. The above compositions are made by combining the base granule ingredients as a slurry, and spray drying to a low level of residual moisture(5–6%). The remaining dry ingredients (e.g. TRIS) are admixed in granular powder form with the spray dried granule in a rotary mixing drum and the liquid ingredients (e.g. perfume) are sprayed onto the resulting granules.

For purposes of demonstrating the improved cleaning performance obtained with detergent compositions of the invention, compositions A, B and C in Table I are used to wash soiled items with water having a hardness level of about 12 grains/gallon in conventional full-scale laundry washing machines with 12 minute wash cycles, after which the items are dried for 50 minutes in conventional dryers. Panelists are asked to compare the clothes washed with detergent compositions B and C with the those clothes washed with detergent composition A which is outside the scope of the invention and assign grades according to the following scale:

0=no difference between two samples

1=think there is a difference

2=know there is a little difference

3=know there is a lot of difference

4=know there is a whole lot of difference

Each panelist grades the samples under standard lighting. Table II provides the results for compositions A, B and C. Composition A is normalized to a PSU score of "0" so as to provide a framework for comparing cleaning performance.

TABLE II

| Stain | PSU A | PSU B | PSU C |
|---|---|---|---|
| Clay (cotton) | 0 | 0.4 | 0.4 |
| Clay (poly/cotton) | 0 | 0.7 | 0.7 |
| Grass (cotton) | 0 | 0.5 | 0.4 |
| Grass (poly/cotton) | 0 | 0.6 | 0.4 |
| Bacon Grease | 0 | 1.1 | 0.9 |
| Gravy | 0 | 0.8 | 1.2 |
| Spaghetti Sauce | 0 | 1.6 | 1.1 |
| Chocolate Pudding | 0 | 0.7 | 0.6 |
| Blood | 0 | 0.1 | 0.2 |

From the results shown in Table II, it is apparent that granular detergent compositions which include TRIS and are substantially free of bleach arid polyacrylate (compositions B and C) unexpectedly provide improved cleaning over composition A which is outside the scope of the invention.

EXAMPLE II

The following Example presents granular detergent compositions D–G, of which composition E, F and G are made within the scope of the invention while composition D is outside the present invention. More specifically, compositions E, F and G include various levels of TRIS and are substantially free of bleach, while composition D is substantially free of TRIS and includes a bleaching agent (perborate).

TABLE III

| | Compositions (% weight) D | E | F | G |
|---|---|---|---|---|
| Base Granule | | | | |
| $C_{11-14}$ linear alkylbenzene sulfonate | 10.4 | 10.4 | 10.4 | 10.4 |
| $C_{14-15}$ alkyl sulfate | 6.5 | 6.5 | 6.5 | 6.5 |
| $C_{14-15}$ alkyl ethoxy sulfate (EO3) | 1.9 | 1.9 | 1.9 | 1.9 |
| Sodium sulfate | 4.1 | 4.1 | 4.1 | 4.1 |
| Brightener | 0.3 | 0.3 | 0.3 | 0.3 |
| Sodium citrate | 3.5 | 3.5 | 3.5 | 3.5 |
| Sodium carbonate | 22.7 | 22.7 | 22.7 | 22.7 |
| Aluminosilicate | 26.3 | 26.3 | 26.3 | 26.3 |
| Perborate | 1.0 | — | — | — |
| Admix and Spray-on | | | | |
| Lipolase | 0.2 | 0.2 | 0.2 | 0.2 |
| Cellulase | 0.6 | 0.6 | 0.6 | 0.6 |
| $C_{12-13}$ alkyl ethoxylate (6.5 mole) | 0.3 | 0.3 | 0.3 | 0.3 |
| Amylase | 0.9 | 0.9 | 0.9 | 0.9 |
| TRIS | — | 0.25 | 0.5 | 1.0 |
| Misc. (water, perfume, etc.) | 21.3 | 21.0 | 20.8 | 20.3 |
| | 100.0 | 100.0 | 100.0 | 100.0 |
| pH | 8.3 | 8.3 | 8.5 | 8.5 |

Compositions D–G are formulated for use at a level of about 1400 ppm, wash water weight basis, and at temperatures below about 50° C. The above compositions are made by combining the base granule ingredients as a slurry, and spray drying to a low level of residual moisture. The remaining dry ingredients (e.g. TRIS) are admixed in granular powder form with the spray dried granule in a rotary mixing drum and the liquid ingredients (e.g. perfume) are sprayed onto the resulting granules.

For purposes of demonstrating the improved cleaning performance obtained with detergent compositions of the invention, compositions D–G in Table III are used to wash soiled items with water having a hardness level of about 12 grains/gallon in conventional full-scale laundry washing machines with 12 minute wash cycles, after which the items are dried for 50 migrates in conventional dryers. Panelists are asked to compare the clothes washed with detergent compositions E, F and G with the those clothes washed with detergent composition D which is outside the scope of the invention and assign grades according to the scale referenced in Example I. Composition D is normalized to a PSU score of "0" so as to provide a framework for comparing cleaning performance.

TABLE IV

| Stain | PSU D | PSU E | PSU F | PSU G |
|---|---|---|---|---|
| Clay (cotton) | 0 | 0.4 | 0 | 1.3 |
| Clay (poly/cotton) | 0 | 0.4 | 0.3 | 0.9 |
| Grass (cotton) | 0 | 1.6 | 2.1 | 2.2 |
| Grass (poly/cotton) | 0 | 1.1 | 1.4 | 1.1 |
| Bacon Grease | 0 | 0.5 | 0.1 | −0.1 |
| Gravy | 0 | 0.3 | 1.4 | 0.9 |
| Spaghetti Sauce | 0 | 1.2 | 1.0 | 0.6 |
| Chocolate Pudding | 0 | 1.7 | 1.8 | 3.9 |
| Blood | 0 | 1.0 | 0.6 | 0.6 |

From the results shown in Table IV, it is apparent that compositions E, F and G which include TRIS unexpectedly provide improved cleaning over composition D which does not include TRIS and thus, is outside the scope of the invention. It is also surprising that compositions E, F and G which are free of bleach exhibit improved cleaning over composition D which includes a bleaching agent.

Having thus described the invention in detail, it will be obvious to those skilled in the art that various changes may be made without departing from the scope of the invention and the invention is not to be considered limited to what is described in the specification.

What is claimed is:

1. A granular detergent composition consisting essentially of:

(a) from about 5% to about 50% by weight of a detergent surfactant selected from the group consisting of anionic, nonionic, zwitterionic, ampholytic, cationic and mixtures thereof;

(b) from about 5% to about 50% by weight of a non-phosphorous detergent builder selected from the group consisting of aluminosilicate ion exchange material, crystalline layered sodium silicate and sodium citrate;

(c) from about 0.1% to about 2.5% of an enzyme component selected from the group consisting of proteases, amylases, lipases, cellulases and mixtures thereof; and (d) from about 0.25% to about 5% of tris(hydroxymethyl)aminomethane having the formula

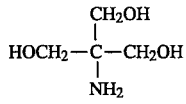

wherein said composition has a pH of from about 8.0 to about 9.0 and is substantially free of phosphates, bleaching agents and polyacrylates.

2. The granular detergent composition of claim 1 wherein said composition comprises from about 10% to about 45% by weight of said builder.

3. The granular detergent composition of claim 1 wherein said composition has a pH of from about 8.2 to about 8.8.

4. The granular detergent composition of claim 1 wherein said composition comprises from about 0.5% to about 2% of said tris(hydroxymethyl)aminomethane.

5. The granular detergent composition of claim 1 wherein said composition has from about 10% to about 45% of said surfactant.

6. A method of laundering soiled clothes comprising the steps of contacting said clothes with an effective amount of a detergent composition according to claim 1 in an aqueous media.

* * * * *

UNITED STATES PATENT AND TRADEMARK OFFICE

CERTIFICATE OF CORRECTION

PATENT NO. : 5,470,509

DATED : November 28, 1995

INVENTOR(S) : Eugene J. Pancheri

It is certified that error appears in the above-identified patent and that said Letters Patent is hereby corrected as shown below:

In Column 3, line 10, change "can," to --can--.

In Column 7, line 46, change "et at." to --et al.--.

In Column 7, line 50, change "et at." to --et al.--.

In Column 9, line 17, change "arid" to --and--.

In Column 10, line 7, change "migrates" to --minutes--.

Signed and Sealed this

Thirteenth Day of August, 1996

*Attest:*

Bruce Lehman

BRUCE LEHMAN

*Attesting Officer*

*Commissioner of Patents and Trademarks*